US005613355A

United States Patent [19]

Koltze et al.

[11] Patent Number: 5,613,355

[45] Date of Patent: Mar. 25, 1997

[54] METHOD FOR REWINDING A SPINNING CAKE IN A POT SPINNING APPARATUS

[75] Inventors: Karl Koltze, Mönchengladbach; Volker Roland, Weissbach; Peter Voidel, Chemnitz, all of Germany

[73] Assignee: Schlafhorst AG & Co., Moenchengladbach, Germany

[21] Appl. No.: 509,509

[22] Filed: Jul. 31, 1995

[30] Foreign Application Priority Data

Jul. 29, 1994 [DE] Germany ..... 44 26 897.1

[51] Int. Cl.[6] ..... D01H 5/28; D01H 9/14

[52] U.S. Cl. ..... 57/312; 57/76; 57/77; 57/261; 57/267; 57/313

[58] Field of Search ..... 57/261, 313, 312, 57/76, 77, 267

[56] References Cited

U.S. PATENT DOCUMENTS

| | | | |
|---|---|---|---|
| 2,520,078 | 8/1950 | Wright | 57/312 |
| 3,205,645 | 9/1965 | Kato | 57/76 |
| 5,289,675 | 3/1994 | Brockmanns et al. | 57/76 |
| 5,385,007 | 1/1995 | Hartel et al. | 57/76 |

FOREIGN PATENT DOCUMENTS

| | | | |
|---|---|---|---|
| 1011787 | 7/1957 | Germany . | |
| 4206030 | 9/1993 | Germany . | |
| 4236379 | 5/1994 | Germany | 57/76 |
| 62-162026 | 7/1987 | Japan | 57/76 |
| 62-162023 | 7/1987 | Japan | 57/76 |
| 62-162027 | 7/1987 | Japan | 57/76 |
| 1666587 | 7/1991 | U.S.S.R. | |

*Primary Examiner*—William Stryjewski

*Attorney, Agent, or Firm*—Herbert L. Lerner; Laurence A. Greenberg

[57] ABSTRACT

A method for rewinding a spinning cake from a spinning pot of a pot spinning apparatus onto a rewinding body, preferably onto a tube as a yarn carrier, includes drawing a sliver to be spun in a drafting configuration, guiding the sliver in a pneumatic piecing aid, and depositing the sliver with a traversing yarn guide onto an inner wall surface of the rotating spinning pot as the spinning cake, while maintaining a requisite rotation for formation of a yarn. A yarn guide is moved toward the middle of the spinning cake in a last stroke being shorter than a next-to-last stroke of the yarn guide toward the middle of the spinning cake, once a predetermined size of the spinning cake is reached, before initiating rewinding of the spinning cake onto the rewinding body. A delivery of the sliver from the drafting configuration is stopped once a reversing point of the stroke is reached. The rewinding body is introduced into the spinning pot and the yarn is transferred onto the rewinding body. The rewinding body is raised into a rewinding position. A piece of yarn extending from a tube tip of the rewinding body to the spinning cake in the last yarn guide stroke is wound onto the rewinding body, and the piece of yarn is covered with subsequently wound-on yarn layers.

6 Claims, 5 Drawing Sheets

METHOD FOR REWINDING A SPINNING CAKE IN A POT SPINNING APPARATUS

BACKGROUND OF THE INVENTION

Field of the Invention

The invention relates to a method for rewinding a spinning cake from a spinning pot of a pot spinning apparatus onto a rewinding body, preferably a tube as a yarn carrier, wherein a sliver to be spun is drawn in a drafting configuration, guided by a pneumatic piecing aid, and deposited by a traversing yarn guide in the rotating spinning pot onto an inner wall surface of the spinning pot as a spinning cake and in the process is kept at the requisite rotation for yarn formation.

In pot spinning apparatuses, a sliver that rotates to form the yarn travels on a long path through a yarn guide. The length of the yarn guide must be such that in any intended piecing position in the spinning pot, it can readily be supplied with sliver from the drafting configuration. In order to facilitate the piecing operation, a pneumatic piecing aid is provided, which pneumatically introduces the sliver into the yarn guide tube in the piecing operation. Such an apparatus is known from German Published, Non-Prosecuted Application DE 42 06 030 A1.

Once the spinning operation is ended, which happens when the spinning cake in the spinning pot has reached a predetermined size and needs to be rewound onto a rewinding body, the delivery of sliver from the drafting configuration must be stopped. In pot spinning apparatuses with pneumatic piecing aids, all of the drafting rollers of the drafting configuration, except for the delivery rollers, are therefore stopped. In that process, the sliver is torn between the drafting rollers and the delivery rollers, and the torn end is fed into the yarn guide. As a rule, by the time the sliver tears, the yarn has already been transferred to the tube onto which the spinning cake is to be rewound. The yarn already tears at the tip of the yarn guide upon transfer of the yarn to the tube by the yarn guide. Should that not happen, then a yarn remnant that would hinder the piecing process would remain in the tube of the yarn guide and could not be removed by suction when the sliver is removed by suction at the outlet of the drafting configuration.

Another problem can be the end of the yarn of the spinning cake. Transferring the yarn to the rewinding body is conventionally carried out whenever the yarn guide is pulled out of the spinning pot and the rewinding body has been introduced all the way into the spinning pot. Since the yarn end of the spinning cake is not fixed to the rewinding body during the transfer, the danger exists of the first windings of the package on the rewinding body becoming loose.

SUMMARY OF THE INVENTION

It is accordingly an object of the invention to provide a method for rewinding a spinning cake in a pot spinning apparatus, which overcomes the hereinafore-mentioned disadvantages of the heretofore-known devices of this general type and which precludes the aforementioned sources of error in the rewinding process.

With the foregoing and other objects in view there is provided, in accordance with the invention, in a method for rewinding a spinning cake from a spinning pot of a pot spinning apparatus onto a rewinding body, preferably a tube as a yarn carrier, which includes drawing a sliver to be spun in a drafting configuration, guiding the sliver in a pneumatic piecing aid, and depositing the sliver with a traversing yarn guide onto an inner wall surface of the rotating spinning pot as the spinning cake while maintaining a requisite rotation for formation of a yarn, the improvement which comprises moving a yarn guide toward the middle of the spinning cake in a last stroke being shorter than a next-to-last stroke of the yarn guide toward the middle of the spinning cake, once a predetermined size of the spinning cake is reached, before initiating rewinding of the spinning cake onto the rewinding body; stopping a delivery of the sliver from the drafting configuration once a reversing point of the stroke is reached; introducing the rewinding body into the spinning pot and transferring the yarn to the rewinding body; raising the rewinding body into a rewinding position; and winding a piece of yarn extending from a tube tip of the rewinding body to the spinning cake in the last yarn guide stroke onto the rewinding body, and covering the piece of yarn with subsequently wound on yarn layers.

In accordance with another mode of the invention, there is provided a method which comprises moving the yarn guide in the last stroke prior to the rewinding, from a lower reversing point toward an upper reversing point.

In accordance with a further mode of the invention, there is provided a method which comprises sending at least one compressed air surge through the yarn guide whenever the yarn guide is operatively connected with the pneumatic piecing aid; blowing a yarn remnant located in an injector of the piecing aid or in the yarn guide into an interior of the rewinding body; and removing the rewinding body after the rewinding process along with a yarn package, from the spinning pot, and initiating a piecing operation.

In accordance with an added mode of the invention, there is provided a method which comprises transferring yarn by dipping the yarn guide into the interior of the rewinding body having entered the spinning pot for the rewinding operation, when the reversing point of the last yarn guide stroke is reached.

In accordance with a concomitant mode of the invention, there is provided a method which comprises adapting a number and intensity of the compressed air surges to yarn parameters.

Since the transfer of the yarn to the rewinding body, which is preferably a tube that is introduced into the spinning pot for rewinding the spinning cake, already takes place inside the spinning cake, rather than not until the final rewinding position of the tube, the length of yarn extending from the tube tip to the point where the yarn is deposited on the spinning cake is first wound onto the tube as it moves upward, and it is then covered by the ensuing windings of yarn in the last complete stroke. This fixes the yarn end of the spinning cake on the tube and effectively prevents the yarn package on the tube from being unwound unintentionally from the end of the winding package.

The yarn guide can be retracted from the spinning pot even while the tube is being raised to its final rewinding position. However, the retraction of the yarn guide can also be postponed until the rewinding body has changed. In order to ensure that the yarn guide is free of any yarn remnant, at least one compressed air surge is sent through the yarn guide through the use of the pneumatic piecing aid. The surge of compressed air is introduced into the yarn guide at its end which is remote from the drafting configuration and flows through it as far as the yarn guide tip, which can extend into the interior of the tube in the spinning pot or is aimed at the tube opening. Any yarn remnant that might remain in the yarn guide is blown out by the surge of compressed air and lands in the interior of the tube. In order to ensure that a yarn remnant has been completely removed from the yarn guide tube, the number and intensity of compressed air surges can be adapted to the yarn parameters. In the case of bulky or hairy yarns, it can be appropriate to set a higher intensity than with smooth, thin yarns. In the case of such yarns it can also be appropriate to repeat the compressed air surge. This assures that the yarn guide tube is cleaned of any yarn remnants and is prepared for the piecing operation.

Other features which are considered as characteristic for the invention are set forth in the appended claims.

Although the invention is illustrated and described herein as embodied in a method for rewinding a spinning cake in a pot spinning apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
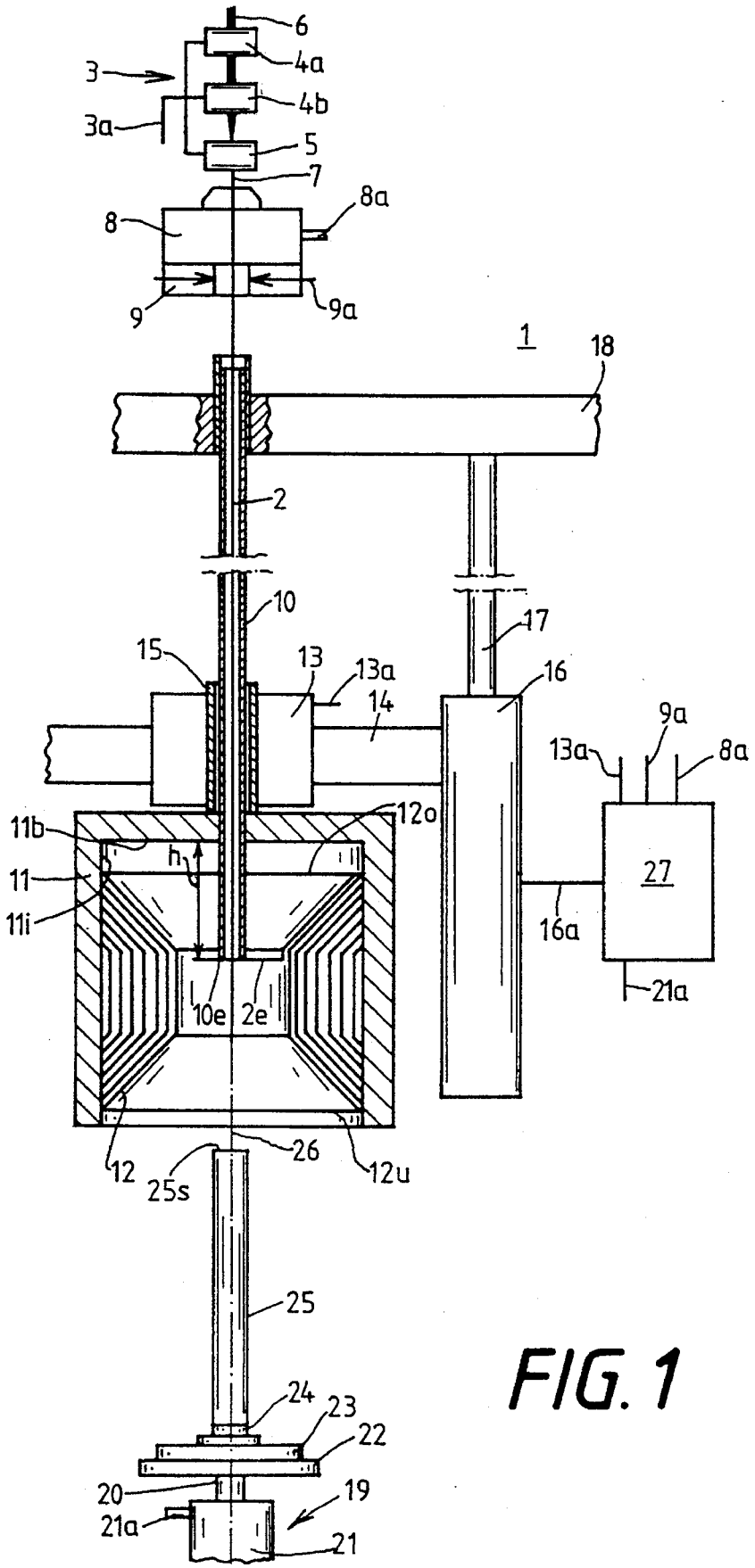
FIG. 1 is a fragmentary, diagrammatic, elevational view of a yarn guide in a final position after a last stroke.

Referring now to the figures of the drawing in detail and first, particularly, to FIG. 1 thereof, there is seen a pot spinning apparatus 1. Only those characteristics that contribute to comprehension of the invention are shown and described. The pot spinning apparatus 1 is one of a plurality of spinning stations in a spinning machine.

In order to produce a yarn 2, the pot spinning apparatus 1 has a drafting configuration 3, of which two drafting roller pairs **4*a* and 4*b* and a delivery roller pair 5 are shown. In the drafting configuration 3, a roving or card sliver 6 is drafted to make a sliver ribbon 7. Through the use of a stationary injector 8 acting as a pneumatic piecing aid, and a yarn sensor 9, the sliver ribbon 7 having been twisted to make the yarn 2, passes through a yarn guide tube 10 which extends into a spinning pot 11 having an inner wall surface 11*i* onto which the yarn 2 is deposited to make a spinning cake 12. The spinning pot 11 is driven by a motor 13, which is disposed on a machine frame 14. A tube of the yarn guide 10 is passed centrally through a hollow drive shaft 15 of the spinning pot 11**.

A control cylinder 16 which may be pneumatic, for example, is also disposed on the machine frame 14, and has a piston 17 that moves a yarn guide bank 18 up and down in order to cause the yarn guide 10, or further yarn guides if applicable, to traverse or move back and forth. The pot spinning apparatus is comparable, in terms of the way in which it is outfitted, to the pot spinning apparatus of German Published, Non-Prosecuted Application DE 42 06 030 A1.

A lifting device 19 which is disposed below the spinning pot 11 has a hydraulic or pneumatic control cylinder 21. A piston 20 of the control cylinder 21, which is oriented perpendicularly to a bottom surface **11*b* of the spinning pot 11, carries a platform 22. Standing on this platform 22 is a disklike carrier body 23 with an arbor 24, onto which an empty tube 25 is placed as a rewinding body. A center line of the empty tube 25 coincides with a center line 26 of the yarn guide tube 10. The control cylinder 21 can be triggered by a control unit 27 through a control line 21*a*** for raising and lowering.

The positioning of an empty tube for rewinding the spinning cake in the form shown is merely an example and can be replaced by any other configuration that is suitable for introducing an empty tube into the stationary spinning pot for rewinding the yarn.

Controlling the pot spinning apparatus 1 is performed through the use of the control unit 27. The control unit 27 is connected to the various units, sensors and motors of the pot spinning apparatus through corresponding signal lines.

FIG. 1 shows a situation when a buildup of the spinning cake 12 is being ended. A last stroke h of the yarn guide 10 is shorter than a next-to-last stroke, which extends over the entire height of the spinning cake 12. As a result, it is ensured that the yarn is not transferred to the empty tube 25 outside the spinning cake. Consequently, the yarn deposited on the spinning cake during the last yarn guide stroke is already unwound onto the empty tube during the course of travel of the empty tube to the final rewinding position and is then covered by the subsequent wound layers of the spinning cake. Thus a yarn end **2*e* of the spinning cake is fixed and secured against being unintentionally unwound. With regard to the invention it does not matter whether the last, shorter stroke of the yarn guide 10 begins at a lower edge 12*u* or an upper edge 12*o* of the spinning cake 12. If the yarn guide has moved downward from the upper edge 12*o* of the spinning cake 12, then the upward motion of the rewinding package, that is the tube 25**, must be faster than the speed with which the yarn layer of the last stroke is unwound, so that this yarn layer will be wound onto the tube.

If the yarn guide 10 has moved upward from the lower edge **12*u* of the spinning cake 12**, then after transfer of the yarn to the tube, the yarn layer of the last stroke is wound onto the tube, counter to the direction of motion of the tube. In both cases, the yarn layer of the last stroke is overwound, or covered up, by the following yarn layer of the next-to-last, complete stroke.

Figure 2:
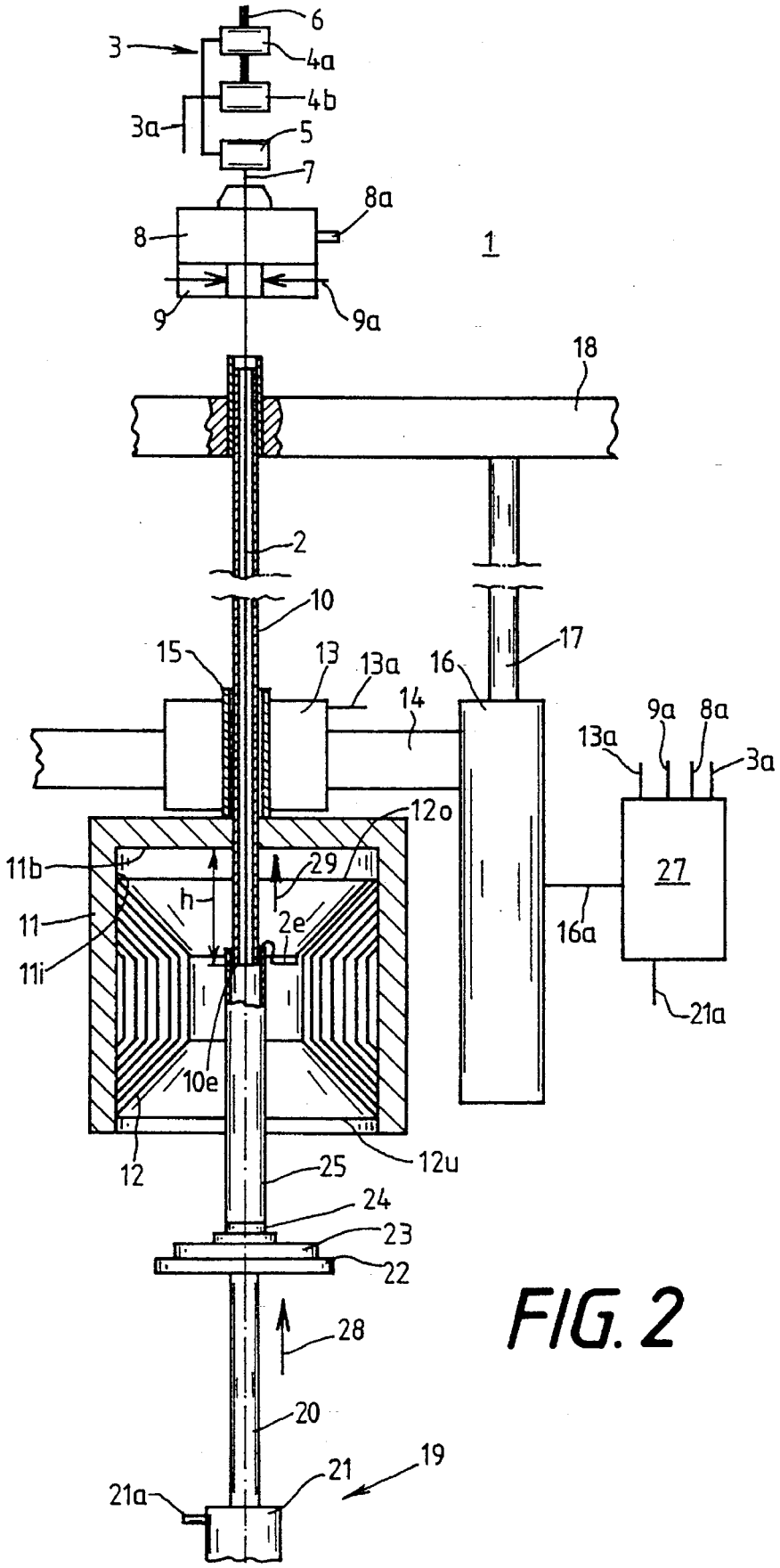
FIG. 2 is a view similar to FIG. 1 showing a transfer of a yarn to a tube as a rewinding body.

FIG. 2 shows the moment at which the yarn end **2*e* of the spinning cake 12 is transferred to the empty tube 25**.

If the spinning cake 12 has reached its requisite size, then in the present exemplary embodiment the yarn guide 10 executes a final stroke h, which is shorter than the next-to-last stroke. For that purpose, the control unit 27 gives the control cylinder 16 a command, through a control line **16*a*, to lower the yarn guide bank or rail 18 far enough, through the use of a piston 17, to ensure that the yarn guide 10 enters the spinning pot 11 by the length of the stroke h. At the same time, through a control line 3*a*, a drive of the drafting roller pairs 4*a* and 4*b* is stopped, while the delivery roller pair 5 continues to rotate. As a result, the sliver ribbon 7 tears between the drafting roller pair 4*b* and the delivery roller pair 5. The delivery roller pair 5 is kept running until a presence of a yarn 2 is no longer reported to the control unit 27 through a signal line 9*a* of the yarn sensor 9**.

While the yarn guide tube 10 has dipped into the spinning pot 11 by the length of the stroke h, or even during this motion into the pot, the empty tube 25 is raised into the spinning pot in the direction of an arrow 28 by the lifting device 19. The transfer of the yarn end 2*e* of the spinning cake to the tube can be performed in such a way that the empty tube 25 is thrust with its tip 25*s* over an end 10*e* of the yarn guide tube. At that moment, the yarn end 2*e* is transferred to the tube 25. The transfer can be facilitated in a known manner, for instance by providing the empty tube 25 with a catcher slit at its tip 25*s*, but this is not shown in this case.

Figure 3:
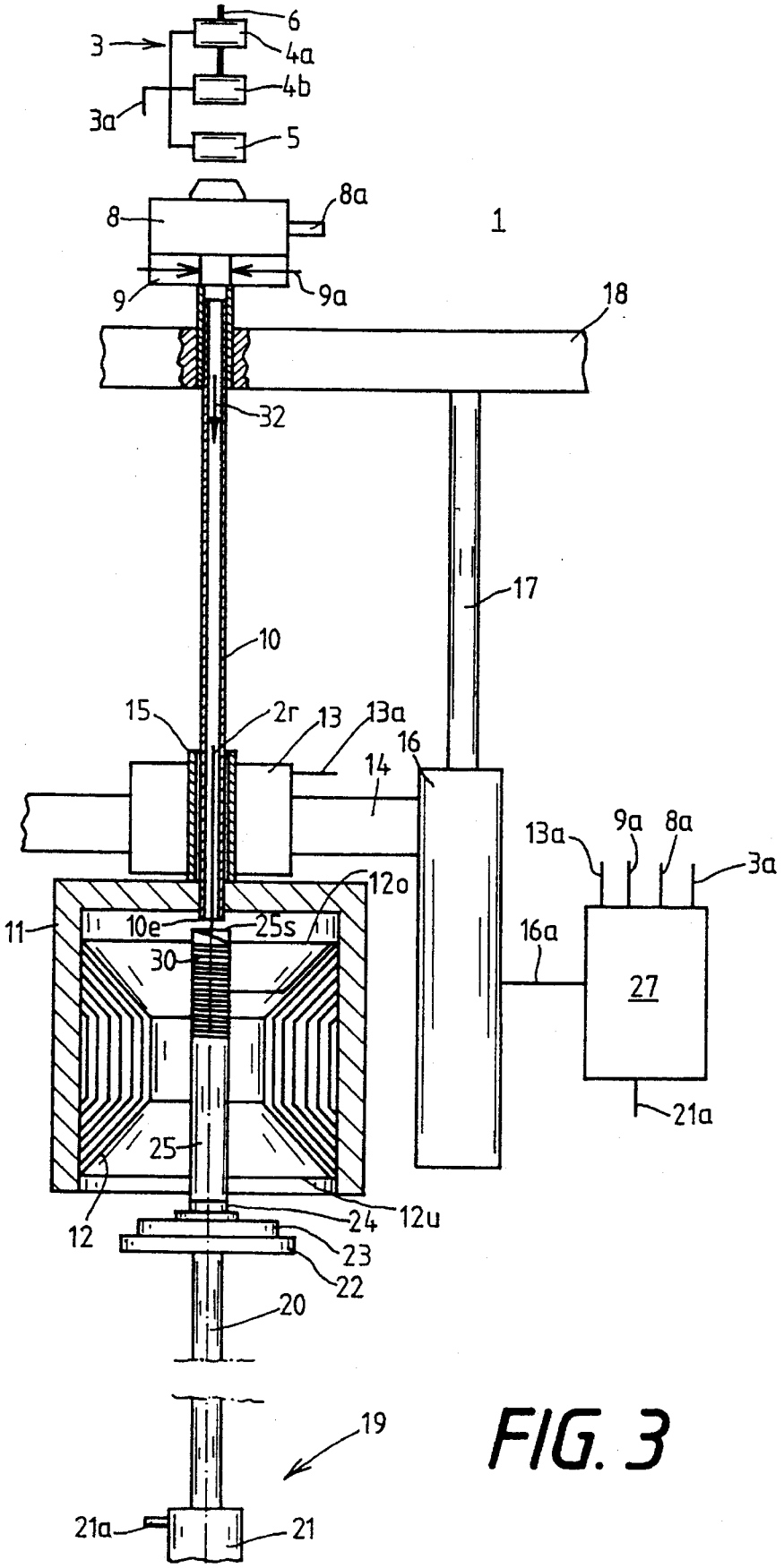
FIG. 3 is another similar view showing the tube in a rewinding position with an overwound yarn end of a spinning cake and an ejection of a yarn remnant from the yarn guide into the interior of the tube by a surge of compressed air.

Once the tip 25*s* of the tube 25 has reached the end 10*e* of the yarn guide 10, the yarn guide is retracted in the direction of an arrow 29 until it has reached a terminal position shown in FIG. 3. This retraction of the yarn guide can also be performed after the tube has been introduced.

FIG. 3 shows the moment at which the operation of rewinding the spinning cake 12 onto the empty tube 25 begins. The yarn guide tube 10 is now retracted far enough to ensure that it stands with its yarn outlet opening 10*e* above the tube tip 25*s*. While the tube 25 is stationary for the rewinding process, the spinning pot 11 continues to rotate at constant speed, driven by the drive motor 13, under the control of the control unit 27 through a control line 13*a*. It can clearly be seen that the yarn end 2*e* engaged on the tube upon yarn transfer has been overwound or covered by the yarn layer 30 that was deposited on the spinning cake in the last stroke h of the yarn guide. This secures the yarn end 2*e* against loosening and coming unwound.

At the high speed at which a spinning pot rotates, the yarn transfer to the empty tube must be performed no later than at the moment when the drafting roller pairs have been stopped. In a conventional yarn transfer, particularly to tubes with a catcher slit, the yarn remains in the yarn guide tube, and the tube receiving it tears the yarn off at the opening of the yarn guide tube.

Figure 4:
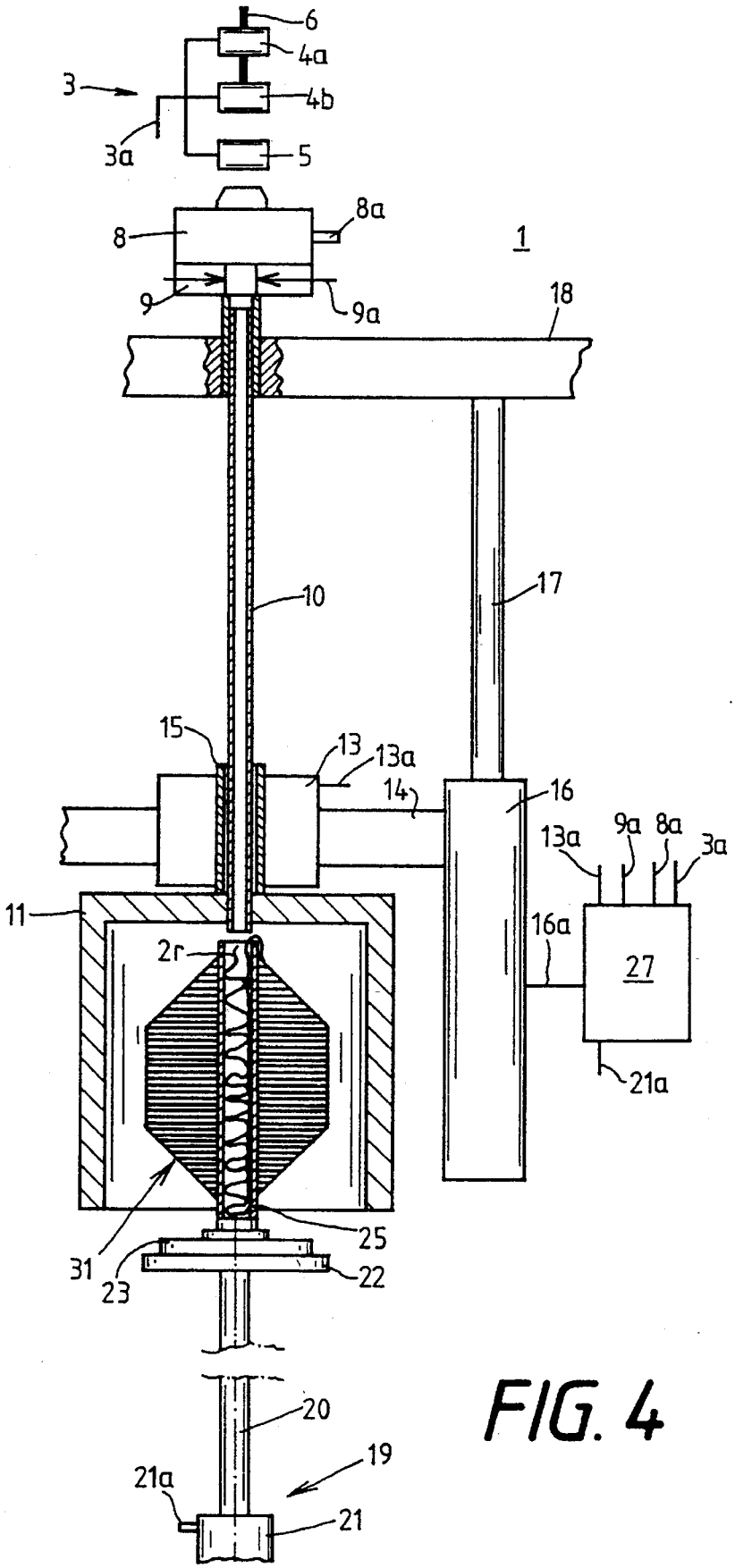
FIG. 4 is a further similar view showing a finished, wound tube with a yarn remnant in the interior of the tube.

Since in the present exemplary embodiment the transfer of the yarn to the empty tube 25 must occur before the yarn has been entirely pulled out of the yarn guide tube 10, the probability is high that there will be a yarn remnant 2*r* in the yarn guide tube 10. There is contact between the yarn guide 10 and the pneumatic piecing aid 8 no later than the moment when the yarn guide and the tube are in the rewinding position, so that it is possible to blow compressed air through the yarn guide tube 10 in order to blow any yarn remnants 2*r* that may have remained behind into the interior of the tube 25. The piecing aid 8 is triggered by the control unit 27 as follows. At least one surge of compressed air is blown into the yarn guide tube 10 through a compressed air supply line 8*a*, as is represented by an arrow 32. If a yarn remnant 2*r* has indeed remained in the yarn guide tube 10 upon transfer of the yarn to the tube, then this remnant is blown into the interior of the tube 25, as is shown in FIG. 4. Thus the yarn guide tube 10 is free for a new piecing operation, and the yarn remnant 2*r* that might have remained has thus been deposited into the interior of the tube in such a way that as the bobbin is transported elsewhere, this remnant cannot cause any problems in transporting or further unwinding.

FIG. 4 shows the conclusion of the rewinding operation. The spinning cake 12 has been entirely rewound onto the tube 25 to form a yarn package 31 and the spinning pot 11 is empty. A yarn remnant 2*r* can be seen in the interior of the tube 25 in FIG. 4. This is the remnant yarn that remained in the yarn guide tube 10 once the yarn end 2*e* coming from the spinning cake had been engaged by the empty tube 25.

Figure 5:
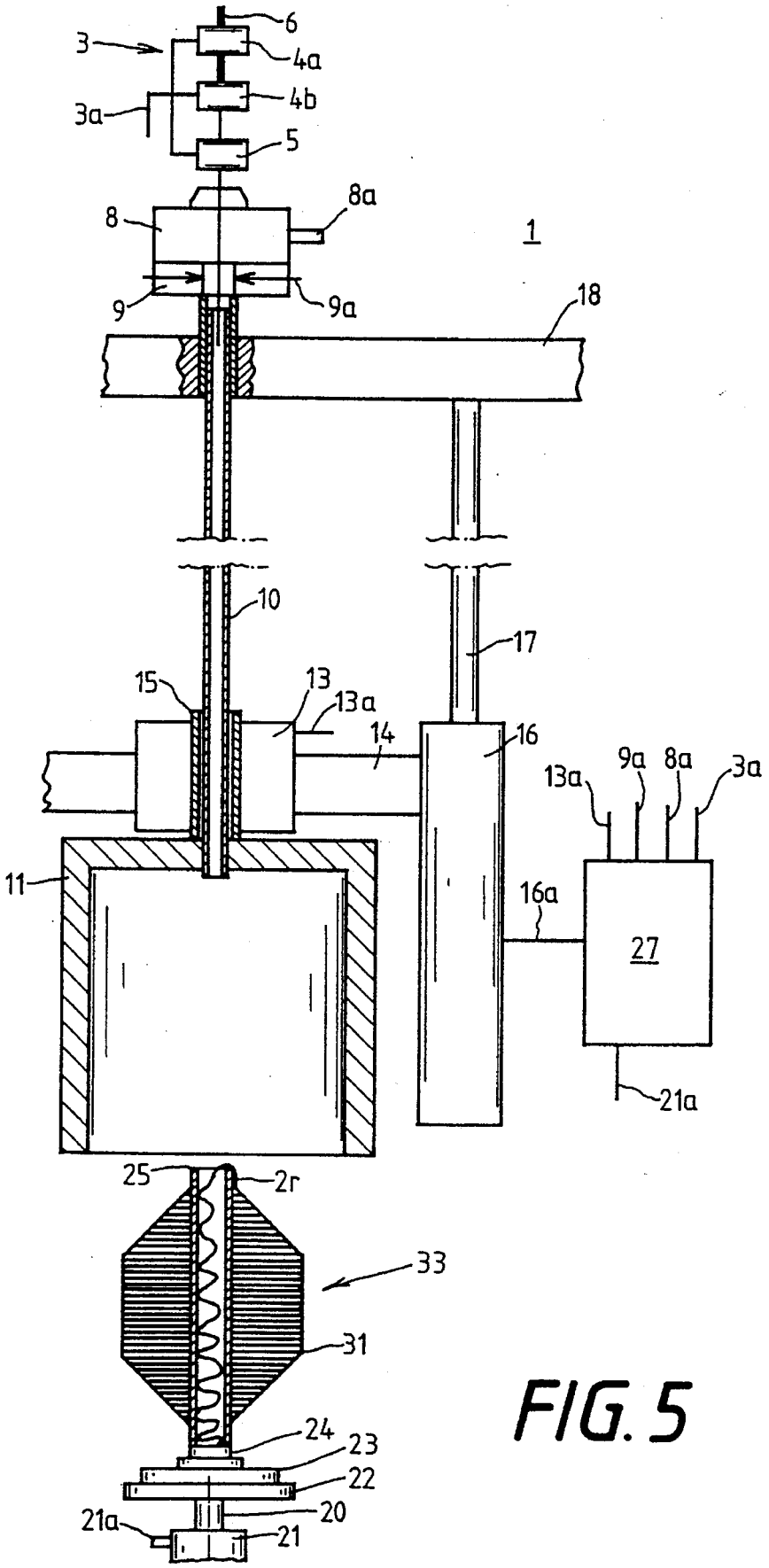
FIG. 5 is an additional similar view showing the tube with the yarn package being moved out of the spinning pot.

FIG. 5 shows a completely wound bobbin 33, which has been lowered out of the interior of the spinning pot 11 with the aid of the lifting device 19. It is now in a position that enables transport for further processing. Conversely, the spinning pot 11 is prepared for a piecing operation. The yarn guide tube 10 is free of yarn remnants. Through the use of the control unit 27, the drafting configuration 3 is put back into operation, and the roving 6 is fed into the pneumatic piecing aid 8, where it is pneumatically introduced into the yarn guide tube 10. The piecing operation proceeds in the manner which is known, for instance, from German Published, Non-Prosecuted Application DE 42 06 030 A1.

We claim:

1. In a method for rewinding a spinning cake from a spinning pot of a pot spinning apparatus onto a rewinding body, which includes drawing a sliver to be spun in a drafting configuration, guiding the sliver in a pneumatic piecing aid, and depositing the sliver with a traversing yarn guide onto an inner wall surface of the rotating spinning pot as the spinning cake while maintaining a requisite rotation for spinning a yarn from the sliver, the improvement which comprises:

moving the traversing yarn guide toward the middle of the spinning cake in a last stroke being shorter than a next-to-last stroke of the yarn guide toward the middle of the spinning cake, once a predetermined size of the spinning cake is reached, before initiating rewinding of the spinning cake onto the rewinding body;

stopping a delivery of the sliver from the drafting configuration once a reversing point of the stroke is reached;

introducing the rewinding body into the spinning pot and transferring a piece of the yarn extending from the traversing yarn guide to the spinning cake to a tube tip of the rewinding body;

raising the rewinding body into a rewinding position; and rewinding the yarn deposited on the spinning cake in the last yarn guide stroke onto the rewinding body, and covering the yarn of the last yarn guide stroke with subsequently wound on yarn layers.

2. The method according to claim 1, which comprises selecting a tube as the rewinding body and, subsequently to the rewinding step, rewinding the spinning cake from the spinning pot onto the tube as a yarn carrier.

3. The method according to claim 1, which comprises moving the yarn guide in the last stroke prior to the rewinding, from a lower reversing point toward an upper reversing point.

4. The method according to claim 1, which comprises sending at least one compressed air surge through the yarn guide whenever the yarn guide is operatively connected with the pneumatic piecing aid; blowing a yarn remnant located in an injector of the piecing aid or in the yarn guide into an interior of the rewinding body; and subsequently to the rewinding step, removing the rewinding body after the rewinding process along with a yarn package, from the spinning pot, and initiating a piecing operation.

5. The method according to claim 4, which comprises adapting a number and intensity of the compressed air surges to yarn parameters.

6. The method according to claim 1, wherein the transferring step comprises dipping the yarn guide into the interior of the rewinding body having entered the spinning pot for the rewinding operation, when the reversing point of the last yarn guide stroke is reached.

* * * * *